United States Patent [19]

Yonker

[11] 4,103,740

[45] Aug. 1, 1978

[54] WELL TOOL WITH A PAWL

[75] Inventor: John H. Yonker, Carrollton, Tex.

[73] Assignee: Otis Engineering Corporation, Dallas, Tex.

[21] Appl. No.: 802,732

[22] Filed: Jun. 2, 1977

[51] Int. Cl.[2] ..... E21B 7/06

[52] U.S. Cl. ..... 166/117.5

[58] Field of Search ..... 166/117.5, 117.6, 55.3

[56] References Cited

U.S. PATENT DOCUMENTS

| | | | |
|---|---|---|---|
| 2,571,934 | 10/1951 | Otis et al. | 164/0.7 |
| 3,610,336 | 10/1971 | Sizer | 166/117.5 |
| 3,752,231 | 8/1973 | McGowen et al. | 166/117.5 |
| 3,827,490 | 8/1974 | Moore et al. | 166/117.5 |
| 3,837,398 | 9/1974 | Yonker | 166/117.5 |
| 3,876,001 | 4/1975 | Goode | 166/117.5 |
| 3,965,979 | 6/1976 | Lamb | 166/117.5 |
| 4,002,203 | 1/1977 | Terral | 166/117.5 |

*Primary Examiner*—James A. Leppink
*Attorney, Agent, or Firm*—Vinson & Elkins

[57] ABSTRACT

Disclosed is a well tool having a pawl for engaging a surface in a well. Once the pawl engages the well surface and has performed its intended function, it is rendered inoperative. The well tool is retrieved from the well and the pawl redressed. This abstract is neither intended to define the invention of the application, which, of course, is measured by the claims, nor is it intended to be limiting as to the scope of the invention in any way.

12 Claims, 5 Drawing Figures

WELL TOOL WITH A PAWL

BACKGROUND OF THE INVENTION

1. Field of the Invention

This invention relates to well tools having a normally projecting pawl for engaging surfaces in a well. The pawl is retracted once it performs its intended function. Redressing of the pawl is accomplished much more easily than has heretofore been possible for a retracted pawl.

2. The Prior Art

Several common well tools have a normally projecting pawl for engaging a surface in a well. The engagement of the pawl with the well surface may locate the well tool with respect to the well surface (see U.S. Pat. Nos. 4,002,203; 3,965,979; 3,876,001; 3,827,490; 3,610,336; and 2,571,934), orient the well tool with respect to the well tubing (see U.S. Pat. Nos. 4,002,203; 3,965,979; 3,876,001; 3,837,398; 3,827,490; and 3,610,336) and/or actuate the well tool (see U.S. Pat. Nos. 4,002,203; 3,965,979; 3,876,001; 3,827,490; and 3,610,336).

For positive engagement with the well surface, the pawl preferably presents a square shoulder, e.g., a shoulder that forms substantially a right angle with respect to the direction of movement of the well tool through the well. (Such shoulders are disclosed in U.S. Pat. Nos. 4,002,203; 3,965,979; 3,876,001; 3,827,490; and 3,610,336).

Once the pawl has engaged the proper well surface and performed its desired function, the pawl is preferably retracted prior to further movement of the well tool through the well. An unnecessarily projecting pawl is particularly undesirable for through-the-flow-line (T.F.L.) pump down well equipment. A projecting pawl has a relatively small surface area compared with the surface area of other components of the well tool. Therefore, during movement of the well tool through the well, particularly if the well is highly deviated or if the flow line extends substantially horizontally along the sea bed, the pawl will be engaged by the tubing and will wear. The resulting wear necessitates that the pawl be replaced frequently. Additionally, through-the-flow-line (T.F.L.) pump down equipment is comprised of short tool sections interconnected by articulating joints. When forces are applied to a tool train formed of such equipment, the tool train may buckle about the articulating joints. Projecting pawls may engage a surface in the well and cause its tool section to hang up in the well. Therefore, to prevent wear on the pawl and to reduce the likelihood that the tool will hang up as it moves through the well tubing, the pawl is retracted after it has performed its useful function. However, once the well tool has returned to the surface, the pawl must be redressed prior to rerunning the tool in the well. If redressing is complicated or takes too much time, work crew expense increases and the number of operations that may be performed using the well tool within a given time interval decreases.

Present well tools having a projecting pawl either do not have a properly retractable pawl or have a complicated manner of redressing the pawl.

The projecting pawls disclosed in U.S. Pat. Nos. 3,965,979 and 3,876,001 are not maintained in a fully retracted position. Therefore, they will wear and will possibly engage a well shoulder resulting in tool hangup if they were utilized on through-the-flow-line (T.F.L.) pump down equipment.

The projecting pawls disclosed in U.S. Pat. Nos. 4,002,203; 3,827,490; and 3,610,336 are resiliently urged towards a position projecting beyond the tool body even after the pawl has been rendered ineffective for providing a positive stop. Therefore the pawl will wear as the tool moves through the well, and the pawl may engage a well shoulder and hang up the tool. Additionally, there is no disclosed manner of maintaining the rotational alignment between the pawl and the tool body once the pawl is rendered partially inoperative. Therefore, redressing potentially could be time consuming.

The well tool disclosed in U.S. Pat. No. 2,571,934 does not include a positive means for moving the pawl to a fully retracted position. If the disclosed shearable member, which holds the pawl in its projecting position, does not shear with a clean fracture, galling may occur between the shearable member and the tool components. Such galling would inhibit free movement of the pawl towards its fully retractable position. Additionally, if the well is highly deviated or includes a pump down loop, the pawl possibly will not be maintained in a fully retracted position during passage of the tool through the highly deviated portion of the well or through the well loop.

Resilient means are generally relied upon to urge the pawl towards its operative, projecting position. Preferably, such resilient means provide a substantially constant, non-binding force on the pawl regardless of the extent of retraction or projection of the pawl. The forces provided by a leaf spring possibly vary depending upon the pawl position. Utilizing a coil spring behind the pawl as disclosed in U.S. Pat. Nos. 3,965,979 and 3,876,001 does not permit full retraction of the pawl once it is rendered inoperative. The ball and coil spring arrangement disclosed in U.S. Pat. No. 3,837,398 binds so that free movement of the pawl is inhibited.

OBJECTS OF THE INVENTION

An object of this invention is to provide a well tool with a normally projecting pawl that is fully retractable once it has served its useful purpose and which is much more easily redressed than has heretofore been possible.

Another object of this invention is to provide a well tool with a normally projecting pawl which is maintained in rotational alignment with the tool body, even during complete retraction of the pawl with respect to the body, to permit quick redressing of the pawl.

Another object of this invention is to provide a well tool having a normally projecting pawl which is urged towards its position projecting beyond the tool body by a non-binding, substantially constant, linear force.

These and other objects and features of advantage of this invention will be apparent from the drawings, the detailed description, and the appended claims.

BRIEF DESCRIPTION OF THE DRAWINGS

In the drawings, wherein like numerals indicate like parts, and wherein an illustrative embodiment of this invention is shown.

DETAILED DESCRIPTION OF THE PREFERRED EMBODIMENT

Although a normal well installation comprises mainly smooth bored tubing sections, the well installation also includes many surfaces which are engageable by well tools. Some of these surfaces are simply collar joints between tubing sections. Other surfaces are within special mandrels in the well tubing. A well surface may be engaged by a pawl of a well tool to locate the tool with respect to the surface, orient the tool with respect to the surface, or actuate the tool.

Figure 1:
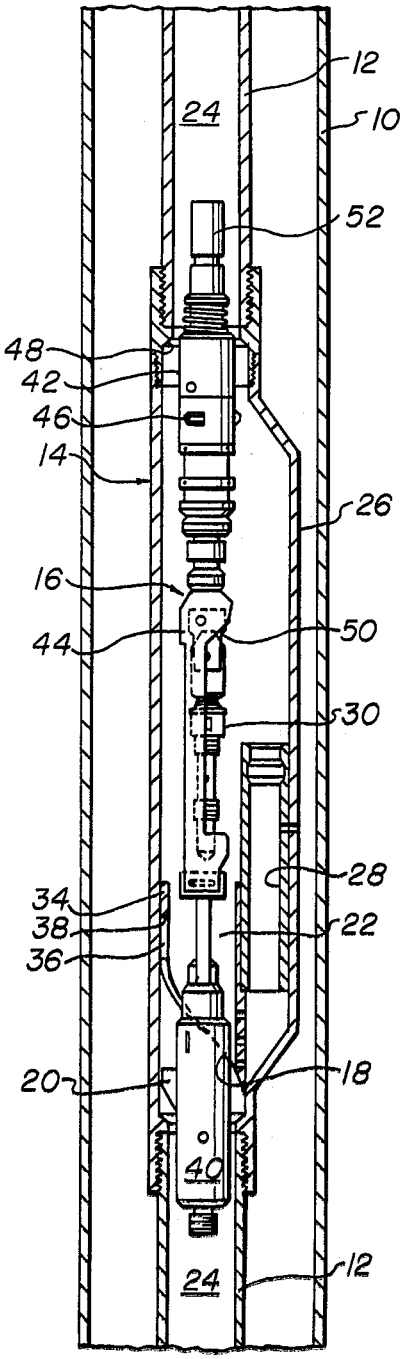
FIG. 1 is an illustration, partially in section and partially in elevation, of a well tool having a projecting pawl being run in a well prior to engagement of the pawl with a surface in the well.
Figure 2:
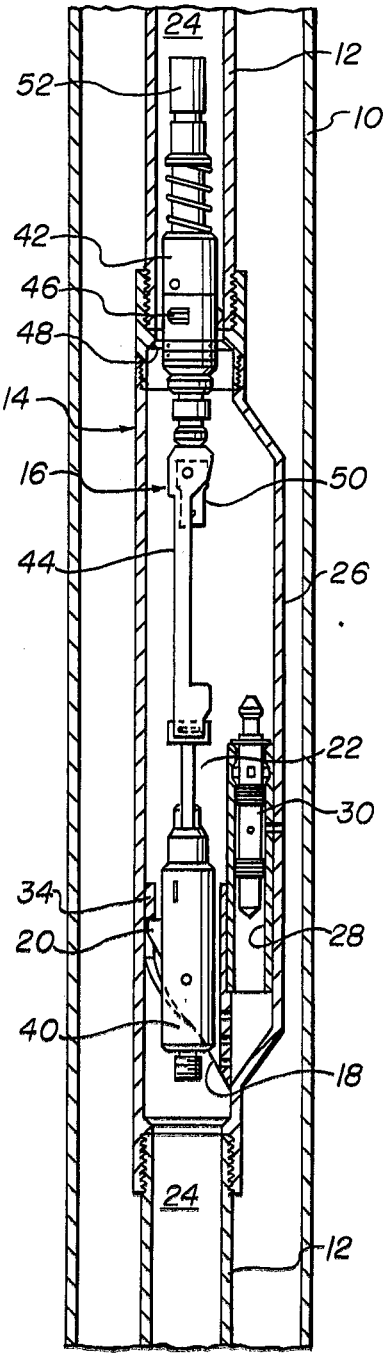
FIG. 2 is a view similar to FIG. 1 showing the pawl engaging a well shoulder to render it inoperative.

A portion of a typical well installation is illustrated in FIGS. 1 and 2. The well is cased with the casing string 10. Extending through the casing string 10 is a tubing string 12. The tubing string 12 often includes mandrels 14 in which a well tool 16 will be operated. Within the mandrel 14 is a surface 18 which will be engaged by pawl means 20 carried on the well tool 16.

The illustrated mandrel 14 is commonly referred to as a side pocket mandrel. It has a longitudinal bore 22 extending therethrough which is substantially aligned with the tubing string bore 24. The side pocket mandrel 14 also includes an offset portion 26 which is offset from the longitudinal bore 22 and which includes a side pocket receptacle 28. The side pocket receptacle 28 is adpated to receive well equipment 30 such as a gas lift valve or the circulating valve shown. The well equipment 30 controls flow between the annulus 32 around the tubing string 12 and the tubing string bore 24.

Within the mandrel 14 is formed an orientation sleeve 34. The orientation sleeve 34 forms the downwardly facing, orientation guide surface 18. The orientation guide surface 18 is engaged by pawl 20 to rotationably align the well tool 16 with respect to the offset 26 of the side pocket mandrel 14. The guide surface 18 terminates in an upwardly extending guide slot 36 formed in orientation sleeve 34. Guide slot 36 maintains the tool 16 in rotational alignment with respect to the offset during manipulation of the tool 16 in the side pocket mandrel 14. Guide slot 36 terminates in a downwardly facing shoulder 38. Shoulder 38 is engageable by pawl means 20 to render pawl means 20 movable to its retracted position.

The well tool 16 illustrated is a kickover tool useable in wells having through-the-flow-line (T.F.L.) pump down systems. The well tool 16 therefore comprises several short interconnected sections. Each section is interconnected in a manner which permits the sections to articulate and flex with respect to each other. The kickover tool 16 is utilized to install or retrieve the circulating valve 30 from the side pocket receptacle 28 of the side pocket mandrel 14. One section 40 of the kickover tool 16 includes pawl means 20.

For through-the-flow-line (T.F.L.) pump down equipment, the design of a well tool having a projecting pawl has several considerations. The pawl 20 should provide a square shoulder for positive engagement with the desired surface 18 in the well. Once the pawl 20 has performed its intended function, it should be rendered fully retractable with respect to the tool body. During subsequent movement of the well tool 16 through the well, the pawl 20 should be maintained in its fully retracted position. Preferably positive means are provided for moving the pawl 20 to, and maintaining the pawl 20 in, its fully retracted position.

There are several undesirable consequences of not having a pawl which is fully retractable which is positively moved to its fully retracted position, and which is positively maintained in its fully retracted position. If after the pawl has performed its useful function, it continues to project laterally beyond the tool body, it will be engaged by many well surfaces as the well tool 16 moves through the well. That engagement will unnecessarily wear down the pawl. The pawl will have to be replaced frequently. Additionally, forces applied to a multi-sectioned tool train, wherein each section of the train is interconnected to another section by articulating, flexible joints causes the train to buckle. Such buckling could result in the pawl engaging a well shoulder. The tool train could thereby become hung up in the tubing or flow line. Fully retracting the pawl under the influence of a positive means therefore reduces the likelihood of such hang up. During movement of a well tool 16 through highly deviated portions of the tubing, through the conventional loop or through the horizontal flow line, the pawl 20 could possibly tend to seek a position projecting laterally beyond the tool body with all the inherent dangers that entails. Therefore, positive means are preferably provided to maintain the pawl in its fully retracted position. Once the well tool is returned to the surface, the pawl should be capable of being easily redressed so that the well tool 16 may be quickly rerun in the well. If necessary, orientation of the pawl with respect to the tool body should be maintained, even when the pawl is fully retracted, so that the pawl may be more easily redressed.

Preferably a substantially constant linear force is applied to the pawl to urge it towards a position projecting laterally beyond the tool body. The application of a force urging projection of the pawl should not result in a binding interaction between the pawl and the force applying means. Any such binding interaction could interfere with free retraction or free projection of the pawl.

The pawl 20 is carried by the well tool 16 in a manner to obtain the aforementioned considerations which are desirable and to substantially reduce the aforementioned consequences which are undesirable.

Except for the tool section 40, the well tool 16 may be structured as disclosed in U.S. Pat. No. 3,837,398, the entire disclosure of which is hereby incorporated by reference for all purposes. The kickover tool 16 will install or retrieve a circulating valve 30 from the side pocket receptacle 28 of a side pocket mandrel 14 in the manner described in that patent.

As more fully described in the aforementioned patent, the kickover tool 16 includes a tool body formed from several interconnected sections. Each section may articulate and flex with respect to other sections. The tool 16 includes an actuation section 42, an equipment carrier section 44, and an orientation section 40. The tool actuation section 42 includes actuating lugs 46 which engage a shoulder 48 in the well to actuate the tool 16. The equipment carrier section 44 includes kickover means 50. The kickover means 50 articulates and kicks over into the offset 26 of the side pocket mandrel 14 upon actuation of the tool 16 by the actuation section 42. It is the articulation of the kickover means 50 which permits the tool 16 to install or retrieve a circulating valve 30 from the side pocket receptacle 28.

The orientation section 40 includes pawl means 20 which engages the orientation surface 18. Engagement of the orientation surface 18 by the pawl means 20 rotationally aligns the kickover means 50 of the kickover tool 16 with the side pocket offset 26.

In operation, the kickover tool 16 is connected to a force applying and moving means, which may be a pump down tool train or a wire line, through sub 52. If a circulating valve 30 is being installed in the side pocket receptacle 28, the valve 30 is releasably positioned along the equipment carrier section 44 with the kickover means 50 fastened thereto and aligned therewith. The tool train is run through the well. The kickover tool 16 is run through the tubing string 12 until the orientation section 40 is spaced below the orientation guide surface 18 in the well (see FIG. 1). The kickover tool 16 is raised. Pawl means 20 positively engages the orientation guide surface 18 and aligns kickover means 50 with the side pocket offset 26. The actuating lugs 46 engage the actuating shoulder 48. The kickover means 50 is articulated with respect to the equipment carrying section 44 and the rest of the tool 16. It becomes aligned with the side pocket receptacle 28. The valve 30 is also aligned with the side pocket receptacle 28. The tool 16 is lowered until the valve 30 becomes locked in the side pocket receptacle 28. An upward force is applied to the tool 16. The kickover means 50 releases from the valve 30. Further upward movement of the kickover tool 16 will cause the lugs 46 to re-engage the shoulder 48. The actuation section permits the kickover means 50 to return to a position aligned with the equipment carrier section 44. During continued upward movement of the tool 16, pawl means 20 will strike a deactivating shoulder 38. Pawl means 20 will thereafter be positively moved to a fully retracted position with respect to the orientation section 40 and be positively maintained in that position. The kickover tool 16 is retrieved from the well without any of the dangers which are inherent square shouldered pawl projects laterally beyond the tool body.

Figure 3:
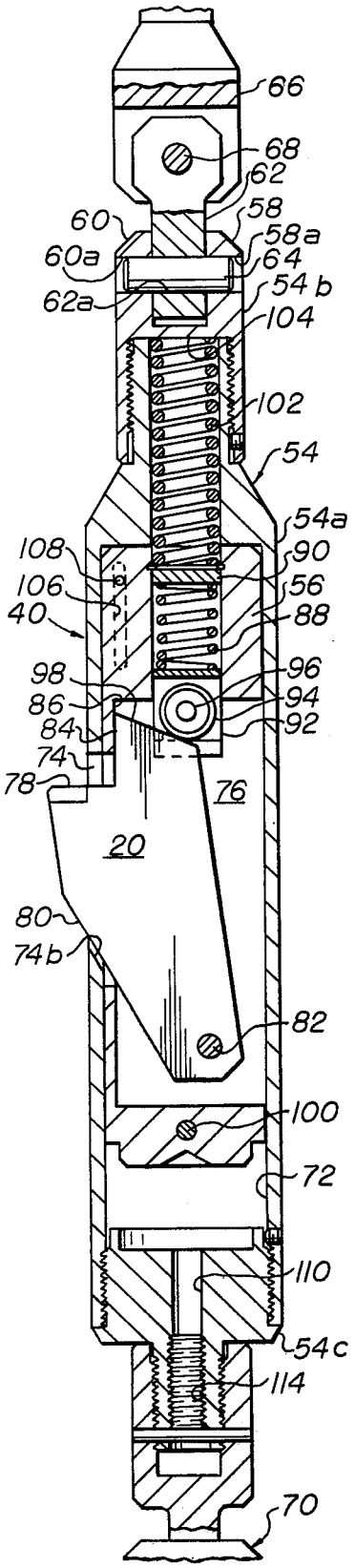
FIG. 3 is a view, partially in section and partially in elevation, of a portion of the tool of FIGS. 1 and 2 illustrating the pawl in its operative, projecting position.
Figure 4:
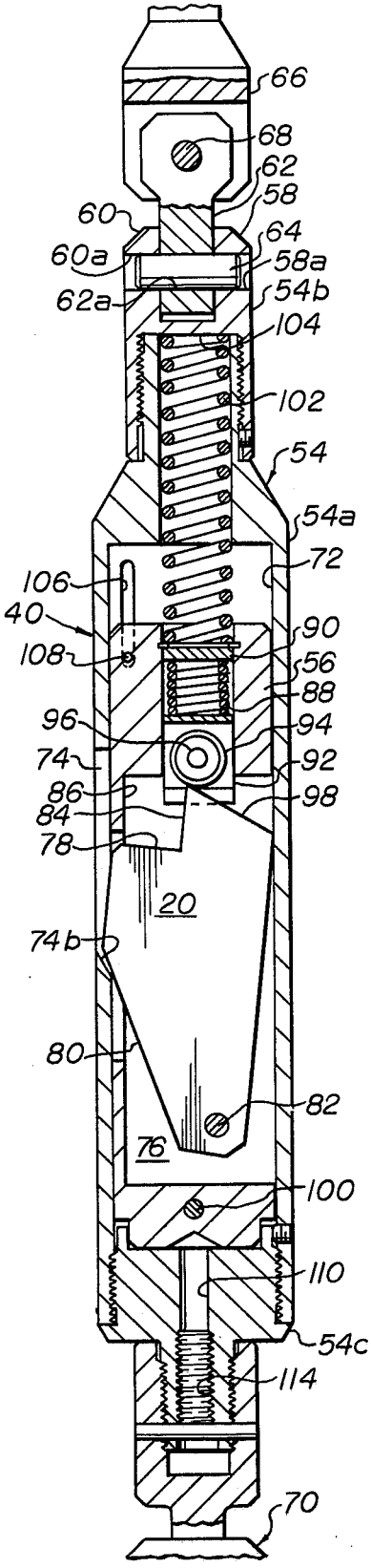
FIG. 4 is a view similar to FIG. 3 showing the pawl fully retracted.

The detailed structure of a tool section 40 incorporating pawl means 20, in accordance with this invention, is illustrated in FIGS. 3 and 4. In FIG. 3, pawl means 20 is illustrated in its position projecting laterally beyond the extent of the tool body. In FIG. 4, pawl means 20 is illustrated fully retracted with respect to the tool body.

The well tool, including the tool section 40, includes body means 54, carrier means 56 and the square shouldered pawl means 20 which is pivotally mounted to the carrier means 56.

Body means 54 carries the components of the tool section 40 and associates that tool section 40 with other components of the well tool 16 and, if desired, with additional tools in a tool train. Body means 54 includes a main mandrel body **54*a*, a top clevice sub 54*b* threadedly connected to the main mandrel body 54*a*, and a bottom connecting sub 54*c* also threadedly connected to the main mandrel body 54*a*. For the kickover tool 16 illustrated, the orientation tool section 40 is connected to the equipment carrier section 44 in a manner which permits articulation between these sections and which prevents relative angular rotation between these sections. Between the two prongs 58 and 60 of the clevice sub 54*b* is disposed a spacer member 62. Pin means 64 projects through aligned pin holes 58*a*, 60*a* and 62*a* of the prongs 58 and 60 and the spacer member 62, respectively, to form one articulatable non-rotational connection. The spacer member 62 extends up to and is received within another clevice 66 associated with the equipment carrier section 44. A pin 68 connects the spacer member 62 to the clevice 66 of the equipment carrier section 44 to form another articulatable non-rotational connection. The tool section 40 may be connected to other well tools (not shown) by the swivel connection 70 which is threadedly connected to the bottom connecting sub 50*c***.

The body means 54 includes cavity means 72 in which is disposed carrier means 56. The body means 54 also includes window means 74 opening into the cavity means 72 through which pawl means 20 may project.

Carrier means 56 is carried by body means 54 and is disposed within the cavity means 72. Carrier means 56 is axially movable with respect to body means 54 within the cavity means 72. When carrier means 56 is in its first position (see FIG. 3), pawl means 20 is capable of freely moving between a position projecting through the window means 74 and extending laterally beyond the body means 54 and a retracted position received within the cavity means 72. When carrier means 56 is in its second position (see FIG. 4), pawl means 20 is maintained in a fully retracted position with respect to body means 54. As illustrated, pawl means 20 may be received within the cavity means 72, where it does not project through window means 70 and does not extend laterally beyond body means 54. Carrier means 56 includes slot means (one surface of which is shown as 76) to provide a space in which pawl means 20 is movable.

Pawl means 20 is carried by the carrier means 52. Preferably, pawl means 20 includes square shoulder means 78. Square shoulder means 78 forms substantially a right angle with the longitudinal axis through the tool section 40 when pawl means 20 is in its outermost projecting position (see FIG. 3). Such a square shoulder means 78 assures positive engagement between pawl means 20 and the desired well surface 18 upon movement of the well tool 16 in one direction through the well. Pawl means 20 also includes a chamfered surface 80, at least a portion of which extends beyond body means 54 when pawl means 20 is in its outermost projecting position. Chamfered surface 80 engages obstructions in the well during movement of the well tool 16 in the other direction through tubing string 12 to thereby move pawl means 20 to a retracted position. To permit movement of pawl means 20 within the slot of the carrier means 52 between its outermost projecting position shown in FIG. 3 and a retracted position, pawl means 20 is pivotally mounted on carrier means 52 by pivot pin means 82. When pawl means 20 swings to its outermost projecting position (see FIG. 3), its shoulder 84 engages a lip 86 of the carrier means 56 to prevent further outward movement of pawl means 20.

Means are provided for biasing pawl means 20 to its position projecting laterally beyond body means 54. The illustrated biasing means provides a non-binding, substantially constant linear force urging pawl means 20 towards its projecting position. A positive, resiliently biasing force is generated by coil compression spring means 88. At one end, the spring means 88 bears against a retainer member 90 which is stationary with respect to carrier means 56. At its other end, spring means 88 bears against movable roller retainer means 92. Roller retainer means 92 is movable in a direction substantially parallel to the longitudinal axis through tool section 40. Roller means 94 is journaled at 96 thereon. Roller means 94 engages a surface 98 of pawl means 20 which is sloped with respect to the longitudinal axis through the tool section 40. As roller means 94 freely turns on journal means 96, a substantially constant force is applied to pawl means 20 urging pawl means 20 towards its projecting position. The vertical center line through roller means 94, should be such that when pawl means 20 is fully retracted, the tip of the surface 98 remains on one side of that center line and does not pass through the center line.

The carrier means 52 is releasably held in its first position, wherein pawl means 20 is permitted to swing between an outermost projecting position and a fully retracted position, by releasable holding means, such as shear pin means 100.

Positive means are provided for resiliently urging carrier means 52 towards its second position. This positive resiliently urging means 102 positively moves and holds carrier means 52 in its second position once shear pin means 100 shears. Shear pin means 100 may shear in a manner which does not provide smoothed sheared surfaces. After shearing, portions of shearing means 96 may gall against either body means 54 or carrier means 56. Such galling would inhibit movement of carrier means 56 with respect to body means 54. The resilient urging means 102 is preferably strong enough to overcome any such possible resistance to movement of carrier means 56. The resilient urging means 102 may be a coil compression spring means 102 having an expansive spring force of at least approximately 75 pounds. At one end, the coil spring means 102 engages a surface 104 of body means 54. At its other end, it engages the retainer member 90 which is fixed with respect to the carrier means 56.

Figure 5:
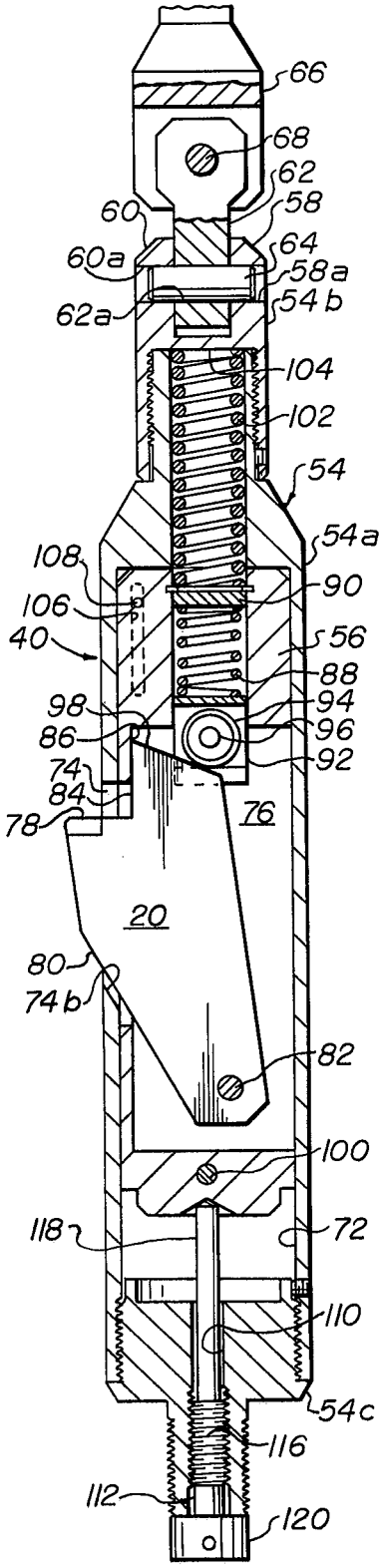
FIG. 5 is a view similar to FIG. 3 illustrating redressing of the pawl.

Once shear pin means 100 sheared, the tool 16 is redressed by moving carrier means 56 to its first position and replacing the sheared shear pin means 100 with a new shear pin means 100. That shear pin replacement is much easier if carrier means 56 does not rotate about its longitudinal axis with respect to body means 54. Additionally, since the tool section 40 is an orientation section, pawl means 20 has a designed rotational alignment with respect to body means 54. Therefore, means are provided for maintaining the desired rotational alignment between carrier means 52 and body means 54. Body means 54 includes longitudinally extending slot means 106 (shown in dotted form in FIGS. 3 and 5). Carried by carrier means 56 is pin means 108 which projects into the slot means 106. The projection of pin means 108 into slot means 106 maintains carrier means 56 axially aligned with respect to body means 54 during the relative movement of carrier means 56 with respect to body means 54.

In accordance with this invention, carrier means 56 is easily returnable to its first position for redressing of the tool 16. Since the force of the resilient urging means 102 must be overcome to return carrier means 56 to its first position, mechanical advantage means are provided which enable the force of spring means 102 to be overpowered. The body means 54 includes aperture means 110 opening into cavity means 72. Redressing tool means 112 (see FIG. 5) may extend through the aperture means 110 and engage carrier means 56 to move it to its first position. The body means 54 also includes mechanical advantage means, such as the illustrated threads 114 which are formed around a portion of the aperture means 110. The mechanical advantage means 114 cooperates with redressing tool means 112 to move and hold carrier means 56 against the force applied by resiliently urging spring means 102.

Redressing tool means 112 (see FIG. 5) is designed to extend through aperture means 110 of body means 54. It is sized to move and hold the carrier means 56 in its first position. Redressing tool means 112 includes mechanical advantage means, such as threads 116, which cooperate with the mechanical advantage means 114 of body means 54. A probe 118 of redressing tool means engages carrier means 56. The length of the probe 118 is such that when the head 120 of redressing tool means 112 bottoms out on the lower end of the connecting sub **50*c*, carrier means 56 is in its first position. Alternatively, when the carrier means is moved upwardly until its upper end engages the upper end of body cavity 72, the shear pin holes in the carrier and body are aligned and shear pin 100 can be readily replaced. Carrier means 56 will be maintained in its first position by the probe 118 due to the coengagement of the threads 114 and 116**.

In operation, pawl means 20 is carried on a well tool 16 and is utilized to positively engage a surface 18 in a well.

The well tool 16 is run in a first direction through the well. Pawl means 20 is biased to a position projecting beyond the body means 54 by spring means 88. When the tool 16 passes through a restriction within the well, the restriction engages the pawl's outer, downward facing chamfered surface 80. That engagement retracts pawl means 20 into the tool body's cavity means 72. In such manner, the well tool 16 may be run to any desired depth in the tubing string 12.

To insure that pawl means 20 engages the desired surface 18 in the well, that section 40 of the well tool 16 which includes pawl means 20 is run past the surface 18 (see FIG. 1). Thereafter, the well tool 16 is run in a second direction through the tubing string 12. The square shoulder means 78 of pawl means 20 positively engages the well surface 18. Upon such engagement, pawl means 20 performs its intended function.

Thereafter, the well tool 16 may be operated to perform its desired function.

Once the pawl means 20 and well tool 16 have performed their respective functions, the projection of pawl means 20 laterally beyond body means 54 is unnecessary and highly undesirable for through-the-flow-line (T.F.L.) pump down equipment. Therefore, the pawl means 20 is moved to, and thereafter maintained in, a fully retracted position with respect to body means 54. To move pawl means 20 to its retracted position, the pawl means 20 engages a deactivating shoulder 38 in the well. Up to this time, carrier means 56 has been releasably maintained by shear pin means 100 in its first position. The engagement of pawl means 20 with the deactivating shoulder 38 applies a shearing force to shear pin means 100. Shear pin means 100 shears. Spring means 102 positively urges carrier means 56 downwardly towards its second position. During the movement of carrier means 56 to its second position, the chamfered surface 80 of pawl means 20 is engaged by the lower chamfered surface **74*b* of window means 70. That engagement cams pawl means 20 inwardly. When carrier means 56 is in its second position, pawl means 20 is in its fully retracted position and is received within the cavity means 72 of body means 54 (see FIG. 4**).

Thereafter, the well tool 16 may be retrieved from the well.

Once the well tool 16 has been retrieved from the well, it is redressed to replace the broken shear pin means 100. Access to aperture means 110 is obtained by removing the swivel connection 70 from the lower connecting sub 54c of body means 54. The probe 118 of redressing tool means 112 is inserted through aperture means 110. The mechanical advantage means 114 formed on body means 54 is engaged by the cooperating mechanical advantage means 116 formed on redressing tool means 112. Their cooperation permits the force of the resilient urging spring means 102 to be overpowered. The carrier means 56 is returned to its first position when the head 120 of redressing tool means 112 bottoms out on the lower end of the connecting sub 54c. Carrier means 56 is maintained in rotational alignment with body means 54 by the confinement of pin means 108 in slot means 106. When carrier means 56 is returned to its first position, the broken shear pin means 100 may be knocked out in an appropriate manner. A new shear pin means 100 is positioned to releasably hold carrier means 56 in body means 54.

After the shear pin means 100 has been replaced, the redressing tool means 112 is run out of aperture means 110. If desired, the swivel connection 70 is reconnected to the bottom connecting sub 54c. The pawl is now repositioned on the well tool 16 so that it may engage a surface 18 in the well.

From the foregoing, it can be seen that the objects of this invention have been obtained. A well tool has been provided with a square shouldered pawl for engaging a surface in a well. The pawl is biased towards a portion projecting laterally beyond the body of the well tool. However, once the pawl has engaged the well surface and performed its desired function, the pawl is fully retractable with respect to the tool body. It is urged to and maintained in a retracted position. In its retracted position, the pawl is protected during subsequent movement of the well tool through the well and cannot contribute to hang up of the well tool as it moves through the well. Upon retrieval of the well tool from the well, the pawl is easily redressed so that the tool may be reused. Redressing ease is obtained by maintaining rotational alignment between a pawl carrier and the tool body. Additionally, easy access is provided for a redressing tool. The redressing tool and tool body cooperate in a manner which provides mechanical advantage for returning the pawl carrier to a position wherein the pawl may project laterally beyond the tool body.

The foregoing disclosure and description of the invention are illustrative and explanatory thereof. Various changes in the size, shape, and materials, as well as the details of the illustrated construction, may be made within the scope of the appended claims without departing from the spirit of the invention.

What is claimed is:

1. In combination:

a well tool comprising:

body means, carrier means carried by said body means and movable with respect to said body means between a first position and a second position, pawl means carried by said carrier means and when said carrier means is in its first position being movable between a position projecting laterally beyond said body means and a retracted position with respect to said body means and when said carrier means is in its second position being maintained in a retracted position with respect to said body means, means for resiliently urging said carrier means towards its second position, means for releasably holding said carrier means in its first position, means for resiliently biasing said pawl means towards its position projecting laterally beyond said body means, and said body means including aperture means for providing access to said carrier means; and redressing tool means cooperable with said body means and adapted for extending through said aperture means for engaging said carrier means and for moving said carrier means to its first position;

one of said redressing tool means and said body means including mechanical advantage means for overcoming the force of said resiliently urging means.

2. The combination of claim 1 wherein said well tool additionally includes:

means for maintaining said carrier means rotationally aligned with said body means.

3. The combination of claim 1 wherein said resiliently biasing means for said pawl means includes:

coil spring means for providing a resiliently biasing force which is effective upon said pawl means;

roller retainer means engaged by said coil spring means and axially movable with respect to said body means;

roller means journaled on said roller retainer means for engaging said pawl means; and said pawl means including a sloped surface which is engaged by said roller means.

4. A kickover tool comprising:

body means;

kickover means associated with said body means and movable between a first position aligned with said body means and a kickover position with respect to said body means;

means for moving said kickover means to said kickover position; and orientation means associated with said body means for orientating said kickover means with respect to a mandrel in a well, said orientation means including:

at least a portion of said body means, carrier means carried by said body means and axially movable with respect to said body means between a first position and a second position, pawl means carried by said carrier means and when said carrier means is in its first position being movable between a position projecting laterally beyond said body means and a retracted position with respect to said body means and when said carrier means is in its second position being maintained in a retracted position with respect to said body means, means for resiliently urging said carrier means towards its second position, means for releasably holding said carrier means in its first position, means for resiliently biasing said pawl means towards its position projecting laterally beyond said body means, said body means portion having aperture means for providing access to said carrier means by a redressing tool, and said body means portion additionally including mechanical advantage means for cooperating with a redressing tool and for overcoming the force of said resiliently urging means.

5. The kickover tool of claim 4 wherein said orientation means additionally includes:

means for maintaining said carrier means rotationally aligned with said body means portion.

6. The kickover tool of claim 4 wherein said resiliently biasing means for said pawl means includes:

coil spring means for providing a resiliently biasing force which is effective upon said pawl means;

roller retainer means engaged by said coil spring means and axially movable with respect to said body means;

roller means journaled on said roller retainer means for engaging said pawl means; and said pawl means including a sloped surface which is engaged by said roller means.

7. A well tool section for engaging a surface in a well, the well tool section comprising:

body means having a longitudinal extending cavity means and also having side window means opening into said cavity means;

carrier means carried by said body means and disposed within said cavity means and adapted for longitudinal movement with respect to said body means within said cavity means between first and second positions;

pawl means carried by said carrier means and when said carrier means is in its first position being movable between a position projecting through said side window means and extending laterally beyond said body means and a retracted position with respect to said body means and when said carrier means is in its second position being maintained in a retracted position with respect to said body means;

means for resiliently urging said carrier means towards its second position;

means for releasably holding said carrier means in its first position;

means for resiliently biasing said pawl means towards its projecting and extended position;

said body means also having tool access means opening into said cavity means for permitting the engagement of said carrier means by a redressing tool;

mechanical advantage means associated with said body means for cooperating with a redressing tool and for overcoming the force of said resiliently urging means.

8. The well tool section of claim 7 additionally including:

means for maintaining said carrier means rotationally aligned with said body means.

9. The well tool section of claim 7 wherein said resiliently biasing means for said pawl means includes:

coil spring means for providing a resiliently biasing force which is effective upon said pawl means;

roller retainer means engaged by said coil spring means and axially movable with respect to said body means;

roller means journaled on said roller retainer means for engaging said pawl means; and said pawl means including a sloped surface which is engaged by said roller means.

10. In combination:

a well tool section for engaging a surface in a well, the tool section comprising:

body means having longitudinal cavity means and also having side window means opening into said cavity means, carrier means carried by said body means and disposed within said cavity means and adapted for longitudinal movement with respect to said body means within said cavity means between first and second positions, pawl means carried by said carrier means and when said carrier means is in its first position being movable between a position projecting through said side window means and extending laterally beyond said body means and a retracted position with respect to said body means and when said carrier means is in its second position being maintained in a retracted position with respect to said body means within said cavity means, means for resiliently urging said carrier means towards its second position, means for releasably holding said carrier means in its first position, means for resiliently biasing said pawl means towards its projecting and extended position, said body means also including aperture means opening into said cavity means for providing access to said carrier means by redressing tool means, and redressing tool means adapted to extend through said aperture means and engage said carrier means and move said carrier means against the force of said resiliently urging means from its second position to its first position and thereafter maintain said carrier means in its first position while said releasable holding means is being replaced;

one of said body means and said redressing tool means including mechanical advantage means for overcoming the force of said resiliently urging means.

11. The combination of claim 10 wherein said tool section additionally includes:

means for maintaining said carrier means rotationally aligned with said body means.

12. The combination of claim 10 wherein said resiliently biasing means for said pawl means includes:

coil spring means for providing a resiliently biasing force which is effective upon said pawl means;

roller retainer means engaged with said coil spring means and axially movable with respect to said body means;

roller means journaled on said roller retainer means for engaging said pawl means; and said pawl means including a sloped surface which is engaged by said roller means.

* * * * *